US005178413A

United States Patent [19]

King

[11] Patent Number: 5,178,413

[45] Date of Patent: Jan. 12, 1993

[54] SKI POLE SUPPORTING ASSEMBLY

[76] Inventor: Scott M. King, One Silver Hill #2, Natick, Mass. 01760

[21] Appl. No.: 770,568

[22] Filed: Oct. 3, 1991

[51] Int. Cl.[5] ..... A63C 11/00

[52] U.S. Cl. ..... 280/814; 224/247; 224/917; 248/214; 248/316.7

[58] Field of Search ..... 224/247, 248, 257, 258, 224/917; 280/812, 820, 819, 814, 821; 294/147; 248/214, 316.7

[56] References Cited

U.S. PATENT DOCUMENTS

| | | | |
|---|---|---|---|
| 520,053 | 5/1894 | Hopkins | 224/248 |
| 3,187,967 | 6/1965 | Sample | 224/247 X |
| 4,269,435 | 5/1981 | Jarvenkyla et al. | 224/917 X |
| 4,883,290 | 11/1989 | Landa | 224/917 X |
| 4,953,852 | 9/1990 | Adkins | 280/814 |

FOREIGN PATENT DOCUMENTS

| | | | |
|---|---|---|---|
| 3005190 | 8/1981 | Fed. Rep. of Germany | 280/812 |

*Primary Examiner*—Margaret A. Focarino
*Assistant Examiner*—Michael Mar
*Attorney, Agent, or Firm*—Fish & Richardson

[57] ABSTRACT

A ski pole supporting assembly for releasably attaching to a pair of ski poles and supporting them on a chair lift or similar supporting structure including a flexible strap and a pair of clasps attached to the ends of the strap, each clasp having a longitudinal shaft aperture defined by a pair of substantially semicyclindrical wall formations having outer end portions spaced apart by a distance smaller than the larger diameter portion of the ski pole to permit entry of the larger diameter portion of the ski pole into the shaft aperture by lateral movement of the larger diameter portion relative to the clasp with the application of force to deflect the wall formations apart to the larger diameter, the wall formations resiliently returning to the smaller distance to retain the larger diameter portion within the aperture after entry of the pole.

12 Claims, 2 Drawing Sheets

SKI POLE SUPPORTING ASSEMBLY

BACKGROUND OF THE INVENTION

The invention relates to a ski pole supporting assembly for releasably attaching to a pair of ski poles and supporting them on a chair lift or similar support structure.

When riding on a ski lift between downhill ski runs, a skier must keep a firm grip on his/her ski poles to avoid having them fall to the ground, often twenty feet or more below and sometimes at an inaccessible location at a great distance from the top of the hill. Also, the concern about avoiding loss of ski poles may make it difficult for the skier to relax and, for example, take the opportunity of the lift ride to adjust goggles or check the mountain map.

Adkins U.S. Pat. No. 4,953,852 describes a ski pole clip that has a small opening that permits it to pass over the small diameter portion of a ski pole near the basket and slide up the pole to the larger diameter portion near the handle. The clip also has a clipping portion that clips onto the side of a chair lift bar. Separate clips are attached to the separate ski poles.

SUMMARY OF THE INVENTION

The invention features, in general, a ski pole supporting assembly that includes a flexible strap made of weather-resistant material and a pair of clasps attached to the ends of the straps. Each clasp has a longitudinal shaft aperture that is defined by a pair of substantially semicylindrical wall formations, the outer end portions of which are spaced by a distance slightly smaller than the larger diameter of a ski pole. This permits entry of the large diameter portion of the ski pole into the aperture upon application of spreading force to the wall formations, which resiliently return to the smaller distance to retain the ski pole within the aperture. Each clasp is attached to a respective ski pole, and the skier can have the strap hang over a horizontal chair lift bar with the two poles balancing each other. Before getting off the ski lift, the skier can either place the assembly in the skier's pocket or attach both of the clasps to the same ski pole.

In preferred embodiments, the aperture has a diameter that is slightly smaller than the diameter of the large diameter of the ski pole in order to resiliently grip the pole. The ends of the wall formation are flared outward in order to permit grasping by the skier's fingers to facilitate entry or removal of the ski pole. The clasps are made of soft plastic (most preferably a polypropylene or ABS), and the strap is made of a colorfast polypropylene that is silk screenable. The wall formations are preferably spaced apart by a distance between 15/32" and 11/32", most preferably 17/32". The inner diameter of the clasp is preferably between 9/16" and 13/16", most preferably about 11/16".

Other advantages of the invention will be apparent from the following description of a preferred embodiment thereof and from the claims.

DESCRIPTION OF THE PREFERRED EMBODIMENT

The drawings will now be described.

DRAWINGS

STRUCTURE

Figure 1:
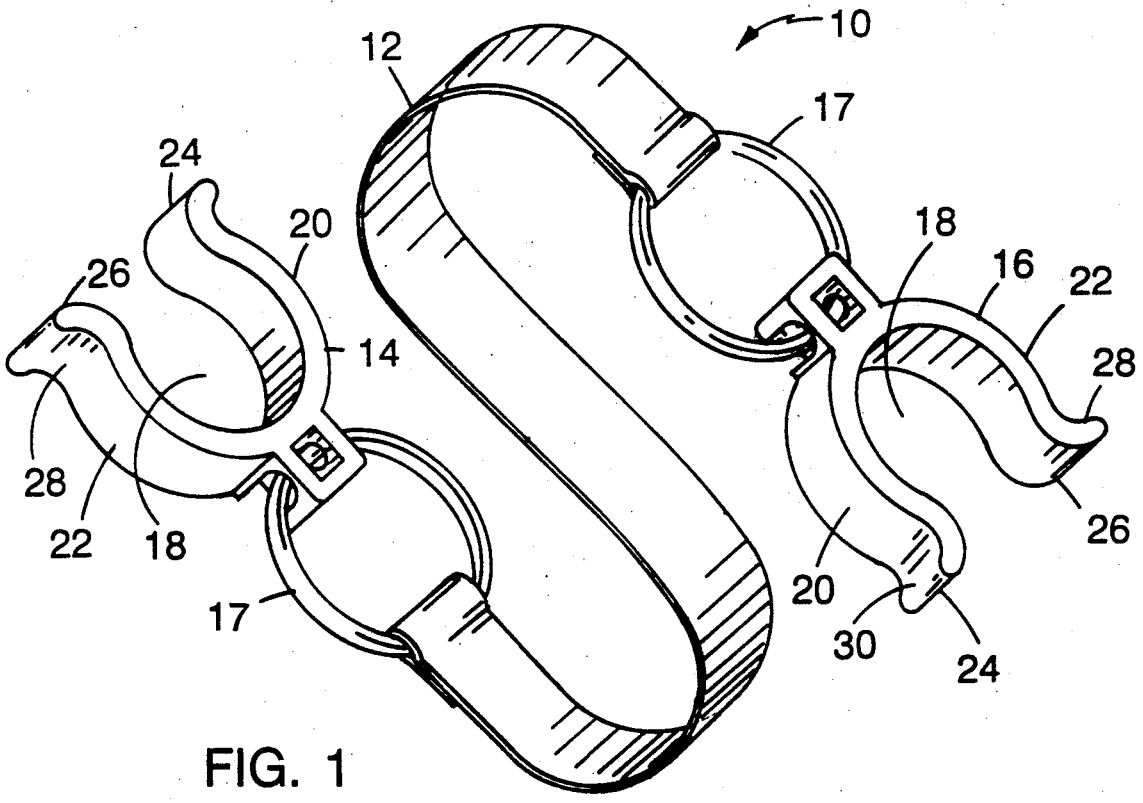
FIG. 1 is a perspective view of an ski pole supporting assembly according to the invention.
Figure 2:
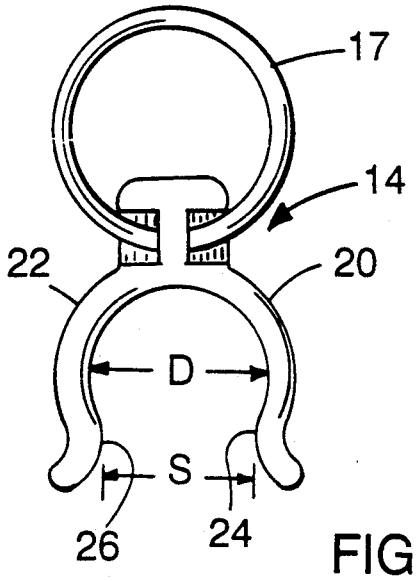
FIG. 2 is a plan view of the clasp of the FIG. 1 assembly.

Referring to FIGS. 1 and 2, there is shown ski pole supporting assembly 10 including strap 12 and clasps 14, 16 attached to the ends of strap 12 by rings 17. Strap 12 is made of polypropylene material that is about ⅝" wide and 10" long, though it could of a different length, for example, be between about 4" and 12". The material is colorfast, can be printed on by silk screening, maintains its properties when subjected to freezing temperature, and has wear and tear resistance. Clasps 14, 16 are made of a soft plastic (most preferably polypropylene or ABS). Each clasp 14, 16 has a shaft aperture 18 therethrough defined by a pair of substantially semi-cylindrical wall formations 20, 22. Wall formations 20, 22 have a wall thickness of about 5/32", though other thicknesses, e.g., between 3/32" and 7/32", could work. The aperture has a diameter D smaller than the large diameter of a ski pole near the handle, which is usually ¾". The diameter D preferably is between 9/16" and 13/16", most preferably about 11/16" in order to lightly resiliently engage the ¾" large diameter of a ski pole. The end portions 24, 26 of wall formations 20, 22 are spaced apart by a distance S that is smaller than the large diameter of a ski pole. This distance is preferably between 15/32" and 11/16", most preferably about 17/32". End portions 24, 26 are flared outward to provide gripping portions to assist in opening the clasp when attaching to or removing from a ski pole.

Figure 3:
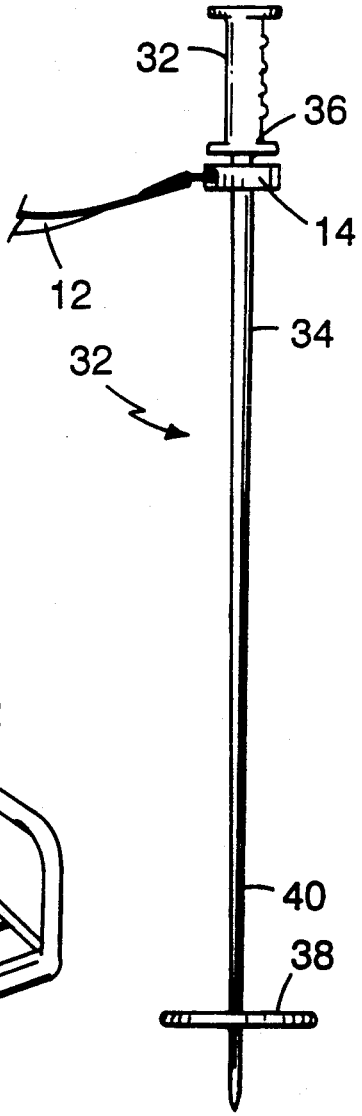
FIG. 3 is an elevation showing a clasp of the FIG. 1 assembly attached to a ski pole.

Referring to FIG. 3, it is seen that when a clasp 14 or 16 is attached to a ski pole 32, it is on the ¾" large diameter portion 34 near handle 36. Ski pole 32 also has a basket 38 and a smaller diameter portion 40, about ¼" in diameter. The ¾" diameter and ¼" diameter are standard dimensions for ski poles in the industry. The flexible properties of clasps 14, 16 permit them to be used with ski poles having slight changes in the large diameter dimension. If there were major changes in the dimensions, the dimensions of clasp 14, 16 would be adjusted accordingly in order to permit the releasable attachment.

USE

Figure 4:
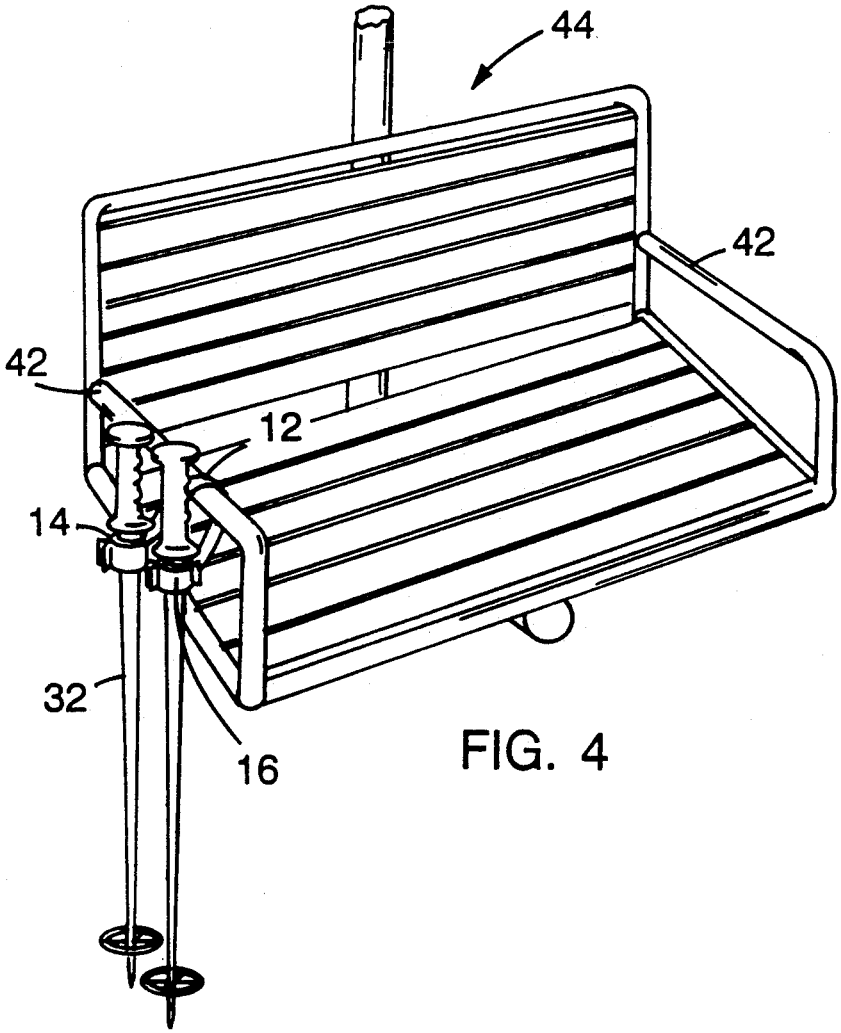
FIG. 4 is perspective view showing a pair of ski poles attached by the assembly to a side bar of a chair lift.

Referring to FIG. 4, it is seen that in use, strap 12 hangs over a horizontal bar 42 of chair lift 44, and the two ski poles hang down from the two ends of the strap. After sitting down on the chair lift, a skier can attach one clasp to a ski pole, place this pole on the outside of the bar 42, take the other clasp around the top of the bar 42 and through the opening underneath the bar 42 and snap it onto the large diameter portion 34 of the other ski pole, and permit the two ski poles the hang downward by gravity. While riding up on the ski lift, the skier will not need to worry about loosing a pole and can relax. As the skier approaches the top of the ski lift, he will undo a clasp 14 or 16 and can either remove the assembly from the ski poles and place it in a pocket or attach both clasps 14, 16 to the same ski pole while skiing down the hill.

Assembly 10 can also be used to hold the ski poles together while walking by allowing the poles to straddle the shoulders.

Other embodiments of the invention are within the scope of the following claims:

What is claimed is:

1. A ski pole supporting assembly for releasably attaching to a pair of ski poles and supporting them on a bar portion of a chair lift or similar supporting structure, said ski poles having small diameter portions near baskets and large diameter portions having a larger diameter near handles, comprising a flexible strap made of weather resistant material and having two ends, and a pair of clasps attached to respective said ends of said strap, each said clasp having a longitudinal shaft aperture extending therethrough defined by a pair of substantially semicylindrical wall formations, each of said wall formations having outer end portions, said outer end portions of said wall formations being spaced apart by a distance smaller than said larger diameter to define a passage permitting entry of said larger diameter portion into said shaft aperture by lateral movement of said larger diameter portion relative to said clasp with the application of force sufficient to deflect said outer end portions apart to said larger diameter and to then resiliently return to a smaller distance to retain said larger diameter portion within said aperture, said aperture having a diameter that is less than said larger diameter of a ski pole, said end portions of said semicylindrical wall formations having flared end portions permitting grasping by a skier to open up the end portions and facilitate entry or removal of said ski pole.

whereby each said clasp can be attached to a respective ski pole and said strap can be supported by said bar portion of said chair lift or similar supporting structure.

2. The assembly of claim 1 wherein the strap is between 4" and 12" long.

3. The assembly of claim 1 wherein said end portions are spaced apart by a distance between 15/32" and 11/16".

4. The assembly of claim 3 wherein said distance is about 17/32".

5. The assembly of claim 1 wherein said aperture has a diameter between 9/16" and 13/16".

6. The assembly of claim 5 wherein said diameter is about 11/16".

7. The assembly of claim 1 wherein said wall formations have a wall thickness of between 3/32" and 7/32".

8. The assembly of claim 7 wherein said wall thickness is about 5/32".

9. The assembly of claim 1 wherein said clasp is made of soft plastic material.

10. The assembly of claim 9 wherein said material is polypropylene.

11. The assembly of claim 9 wherein said material is ABS.

12. The assembly of claim 1 wherein said strap is made of nylon or polypropylene.

* * * * *